United States Patent [19]

Burroughs

[11] Patent Number: 4,635,725

[45] Date of Patent: Jan. 13, 1987

[54] METHOD AND APPARATUS FOR GRAVEL PACKING A WELL

[76] Inventor: Thomas C. Burroughs, 8958 Chatsworth, Houston, Tex. 77024

[21] Appl. No.: 679,625

[22] Filed: Dec. 10, 1984

[51] Int. Cl.[4] ..... E21B 43/04

[52] U.S. Cl. ..... 166/278; 166/51

[58] Field of Search ..... 166/51, 157, 158, 205, 166/278, 381

[56] References Cited

U.S. PATENT DOCUMENTS

| | | | |
|---|---|---|---|
| 1,907,862 | 5/1933 | Pearce | 166/158 |
| 2,155,718 | 4/1939 | Layne et al. | 166/158 |
| 3,421,586 | 1/1969 | Solum | 166/158 |
| 3,913,676 | 10/1975 | Barbee, Jr. et al. | 166/51 |
| 4,018,284 | 4/1977 | Perkins | 166/51 |
| 4,044,832 | 8/1977 | Richard et al. | 166/51 |

*Primary Examiner*—Stephen J. Novosad
*Assistant Examiner*—Bruce M. Kisliuk
*Attorney, Agent, or Firm*—Vinson & Elkins

[57] ABSTRACT

Method and apparatus for gravel packing a perforate liner (12) in a well including a wash pipe (34) carried by a cross-over tool (30) which has a pair of fluid passages (38–40) through which the flow of fluid may be reversed. The wash pipe (34) is mounted in a floating relation within the liner (12) for vertical relative movement and a double acting piston (62) mounted between the liner (12) and wash pipe (34) is responsive to fluid pressure within the liner (12) for moving the wash pipe (34) vertically relative to the liner (12).

13 Claims, 7 Drawing Figures

METHOD AND APPARATUS FOR GRAVEL PACKING A WELL

BACKGROUND OF THE INVENTION

This invention relates generally to gravel packing of oil, gas, or water wells, and particularly to a method and apparatus for such gravel packing utilizing a perforate liner, a wash pipe within the liner, and a cross-over tool connected to the wash pipe having a pair of reversible fluid passages therein.

As an example of prior art apparatus, reference is made to U.S. Pat. No. 3,421,586 dated Jan. 14, 1969, and entitled "Flow-Reversing Liner Shoe for Well Gravel Packing Apparatus". This reference shows apparatus for gravel packing a perforate liner in a well including a cross-over tool supported from well tubing, and a wash pipe connected to the cross-over tool and received in concentric relation within the perforate liner. In operation, during the wash-down procedure in which sand is carried upwardly in the annular space between the exterior of the liner and the interior of the casing, the flow is directed downwardly to open the back flow check valve thereby to provide a jet action to stir up the sand for removal until the liner and associated structure is positioned at the desired depth in the well for gravel packing. Fluid flow in an upward direction in the inner annulus at the lower end of the wash pipe inside the liner is prevented by the bypass means shown in FIG. 4 of aforesaid U.S. Pat. No. 3,421,586 during the wash-down procedure. With the liner positioned at the desired depth the direction of fluid flow in the wash pipe is reversed and gravel packing commences by the pumping of fluid with entrained gravel down through the tubing and then out into the outer annulus outside the liner. However, upon a reversal of fluid flow in the wash pipe to an upward direction for the gravel pack step, fluid flow is permitted downwardly in the annulus about the wash pipe by the bypass means. Such a bypass means acts as a restriction on the downward fluid flow in the annulus within the liner during the gravel pack procedure, and may be undesirably held in a partially open position by foreign matter such as sand or gravel during the initial wash-down procedure. After the gravel has been packed to a predetermined height about the liner, the releasing tool, pack-off tool, and wash pipe are removed from the liner and lifted upwardly with a continued fluid circulation to clean out any fine particles remaining in the liner after the gravel packing. Then, the tubing is lifted for removal of the cross-over tool, releasing tool, and the wash pipe from the well leaving the liner in position for completion of the well for production.

Reference is also made to U.S. Pat. No. 3,913,676 dated Oct. 21, 1975, entitled "Method and Apparatus for Gravel Packing" which shows a method and apparatus for gravel packing a well utilizing cross-over equipment having a production screen. This reference during the wash-down step as shown in FIG. 1B has seals about the lower end of the wash pipe so that the downward flow of flushing fluid in the wash pipe opens the discharge valve and produces a jet action adjacent the end of the liner. After the wash-down step and before the gravel pack procedure, a ball is pumped down the wash pipe or tubing and fluid pressure then moves an inner sleeve downwardly to expose parts so that fluid may flow downwardly in the annular inside the liner and up the wash pipe during the gravel pack procedure. Thus, an additional intermediate step is required between the wash-down procedure and the gravel pack procedure or step.

The above references are examples of prior art apparatus which have been utilized heretofore in gravel packing apparatus in which a sealing connection is required between the lower portion of the work pipe and the liner during the initial wash-down phase with the fluid flow down the wash pipe to prevent an upward fluid flow in the annulus between the liner and wash pipe and a resulting dissipation of fluid pressure from the end of the wash pipe. During the gravel packing step in which the fluid flow is up the wash pipe, it is necessary that this sealing connection be broken so that fluid may flow down the annulus in the liner adjacent the lower portion of the wash pipe. These references accomplish gravel packing without any raising or lifting of the tubing or other supporting apparatus from the ground surface, except upon final disassembly from the liner, but they do require additional steps or additional structures.

A further example of an apparatus and a method for gravel packing a well is shown in U.S. Pat. No. 4,018,284 dated Apr. 19, 1977, and entitled "Apparatus and Method for Gravel Packing a Well" which utilizes a hydraulically actuated fluid diverting means for passageways in the apparatus.

SUMMARY OF THE INVENTION

The present invention is directed particularly to the method and apparatus for gravel packing of a perforate liner in a production zone utilizing a cross-over tool or device having a pair of reversible fluid passages therein and suspending the perforate liner with a wash pipe concentrically mounted within the liner. The wash pipe is mounted within the liner for longitudinal movement relative to the liner between two positions, one a lower wash-down position in which fluid flow is down the wash pipe, and the other an upper raised position in which the wash pipe is raised within the liner in the gravel packing position during which fluid flow is reversed and is up the wash pipe. As a result of raising the wash pipe in the liner during gravel packing, in which the flow of fluid in the wash pipe is reversed, the sealing connection between the wash pipe and liner is broken to permit the downward flow of fluid in the annulus around the wash pipe and then the upward flow out the wash pipe.

To effect relative movement of the wash pipe within the liner without any raising or lifting of tubing, a doubleacting piston responsive to fluid pressure within the liner is secured about the outer periphery of the wash pipe and is positioned in the annulus between the wash pipe and the liner. In the wash-down position in which fluid is pumped downwardly through the wash pipe, fluid pressure acts on the upper side of the double-acting piston to move the wash pipe to a down wash-down position in which a sealing connection is provided between the lower portion of the wash pipe and the liner to produce a jet action adjacent the end of the wash pipe to stir up any sand in the well and entrain the sand in the flowing fluid so that the sand may be carried upwardly in the annulus about the liner for return by the tubing to ground level. Thus, the liner by such wash action is positioned at the desired depth.

When the liner is positioned at the predetermined desired depth for gravel packing, the direction of fluid flow is reversed with fluid moving upwardly in the wash pipe and the lower side of the piston being exposed to fluid pressure to move the wash pipe up to a raised position within the liner, preferably about two feet or more, and breaking the sealing connection between the lower portion of the wash pipe and the liner. After fluid reversal has occurred, gravel is entrained in the fluid flow down the tubing during gravel packing, and with the wash pipe raised within the liner, finely divided particles within the liner that may have passed through the screens are returned with the fluid by the wash pipe during gravel packing to the surface.

After the gravel has been packed around the liner to a predetermined height as determined by an increase in back pressure reached when the gravel covers the tell tale screen, the cross-over tool and wash pipe is then disconnected from the liner and the flow of fluid is again reversed for recirculation a desired amount for cleaning the screens. Then, the cross-over structure is raised to the surface to permit completion of the well for production.

It is an object of this invention to provide for use in gravel packing a perforate liner in a well, a novel assembly having a unique wash pipe mounting which permits the wash pipe to be raised within the liner by fluid pressure upon reversal of the direction of fluid circulation in the wash pipe at the beginning of gravel packing, and without any lifting of the tubing or supporting apparatus.

Other and more detailed objects and advantages of this invention will appear from the following description and the drawings, wherein:

FIG. 1 is a longitudinal sectional view, partly schematic, of the apparatus for gravel packing a perforate liner in a well positioned within a casing in a wash-down position with the fluid flowing down the wash pipe, the wash pipe being in a wash position relative to the perforate liner;

FIG. 2. is an enlarged longitudinal sectional view similar to FIG. 1, but omitting an intermediate portion of the apparatus and showing the apparatus in two longitudinal sections in a wash-down position;

Figure 1:
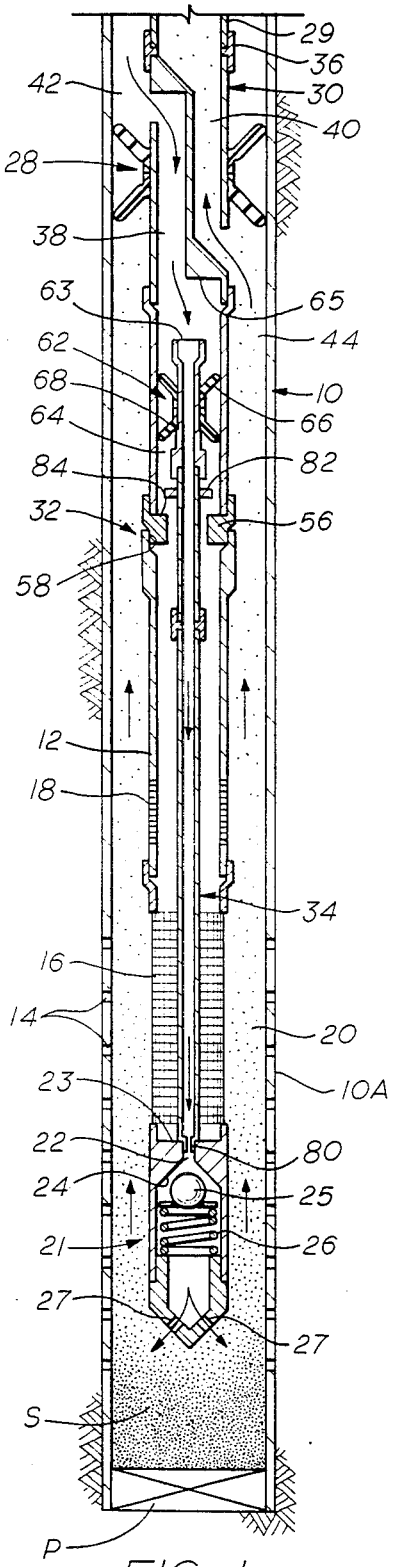
Figure 2:
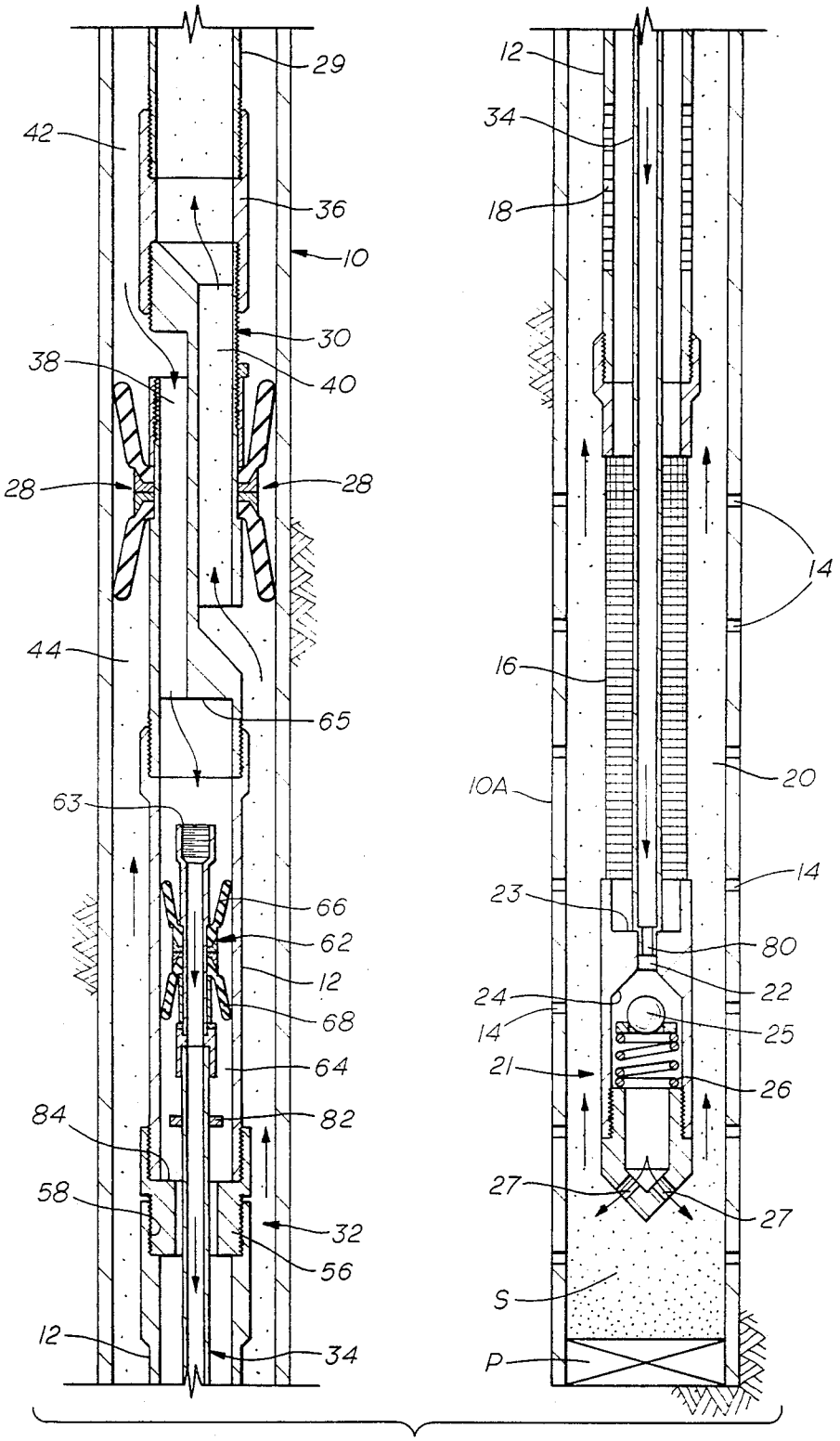
Figure 3:
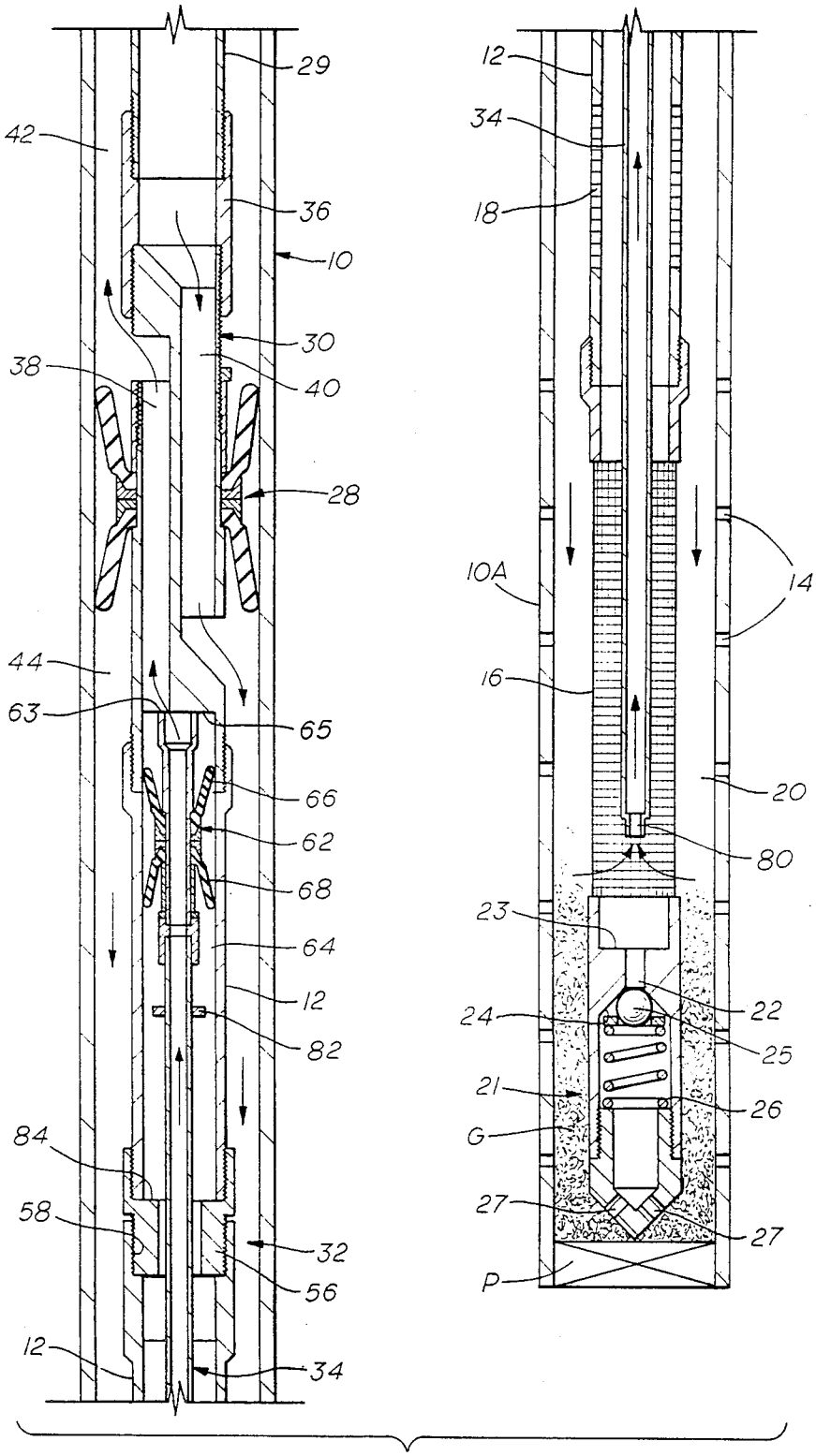
FIG. 3 is an enlarged longitudinal sectional view similar to FIG. 1, but omitting an intermediate portion and showing the apparatus in two longitudinal sections in a gravel packing position with the flow of fluid being reversed and flowing up the wash pipe, the wash pipe being shown in a raised upper position relative to the lower end of the liner.

Referring now to these drawings for a better understanding of this invention, and more particularly to FIGS. 1-3 a tubular casing is generally designated 10 and has a lower end portion 10A positioned within a production zone containing sand S which tends to fill up the bottom of the well by sloughing off the walls. Thus, it is desirable that the bottom of the well be washed out so that a liner 12 can be lowered to the desired depth for production. Lower casing portion 10A is perforated at 14 to receive production fluids therethrough. Under certain conditions, lower portion 10A may be encased in concrete with the perforations being through the concrete also. The lower end of casing 10 is plugged at P to provide a base to support the gravel pack.

Liner 10 has a production screen 16 at its lower end and a tell tale screen 18 spaced vertically from the lower production screen 16. Liner 12 may have a conventional packer (not shown) attached to its upper end for sealing annulus 20 between casing 10 and liner 12 if desired under certain operating conditions. It is desired that liner 12 be positioned at a proper depth in the producing zone which contains sand S, and then packed with gravel G so that the sand S is not entrained with production fluids. The lower end of liner 12 has a shoe designated generally at 21 with a restriction formed by opening 22. Respective upper and lower seats 23 and 24 are provided on opposed ends of opening 22. A back pressure ball check valve 25 is continuously urged by spring 26 into seated engagement with lower seat 24 at a normally closed position. Check valve 25 permits fluid flow in a downward direction but prevents fluid flow in an upward direction. Openings 27 are provided at the end of shoe 21 to permit fluid flow from liner 12 to annulus 20.

Figure 5:
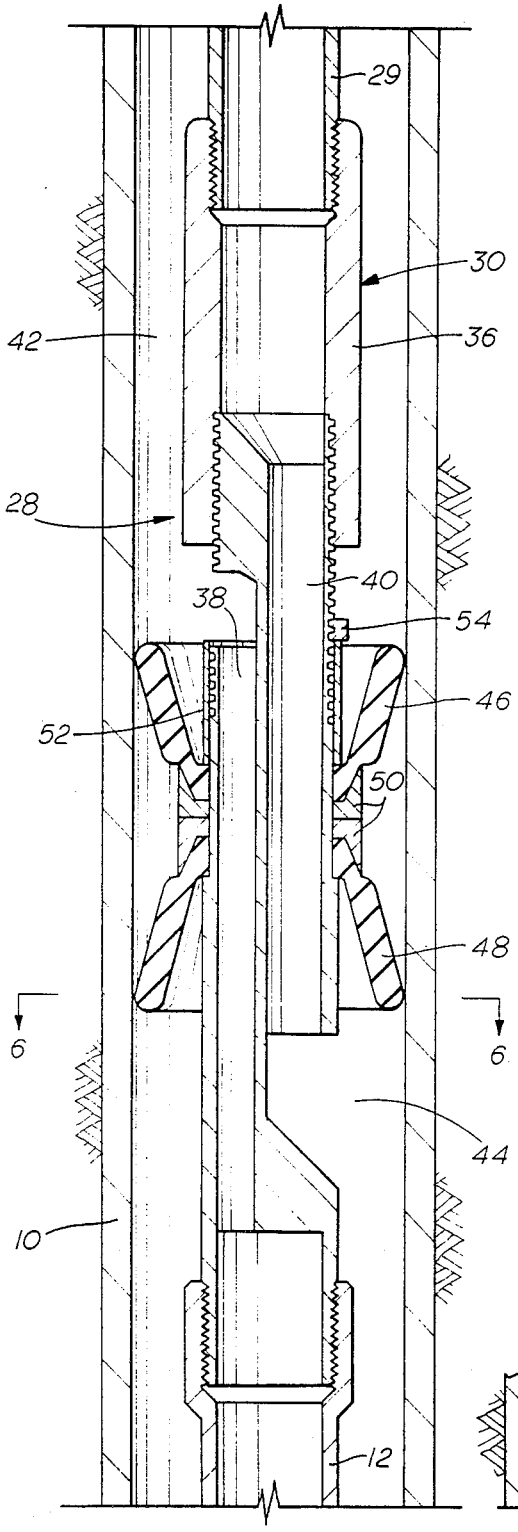
FIG. 5 is an enlarged longitudinal sectional view of the cross-over tool, showing the reversing flow passages therein and opposed annular cup-shaped seals positioned for sealing in both directions.

It is necessary to remove sand S adjacent the end of casing 10 so that liner 12 can be lowered to the desired depth within the production zone for the placing and packing of gravel G around liner 12 so that production fluids will flow through gravel G. For washing sands out from the lower end of casing 10 and to permit the lowering of liner 12 to the desired depth and then packing gravel about liner 12, a cross-over structure generally designated 28 is suspended from a tubing string 29 from the ground surface. Cross-over structure 28 comprises a cross-over tool generally designated 30, a releasable connecting tool generally designated 32, and a wash pipe generally designated 34. Cross-over tool 30 is illustrated particularly in FIG. 5 and includes an upper sub or tubular fitting 36 connected to tubing 29 and a pair of fluid passages 38 and 40 arranged in side-by-side relation. Fluid passage 38 provides fluid communication between annulus 42 above cross-over tool 30 and wash pipe 34. Fluid passage 40 provides fluid communication between annulus 44 below cross-over tool 30, and tubing 29 above cross-over tool 30. To seal annulus 42 above cross-over tool 30 and annulus 44 below cross-over tool 30, upper and lower annular cup-shaped seals 46 and 48 are provided. Seals 46 and 48 are mounted on cross-over tool 30 by mounting rings 50, a retaining sleeve 52, and a lock nut 54 which holds retaining sleeve 52 in tight gripping engagement with upper seal 46 thereby to secure seals 46, 48 tightly on cross-over tool 30.

Figure 4:
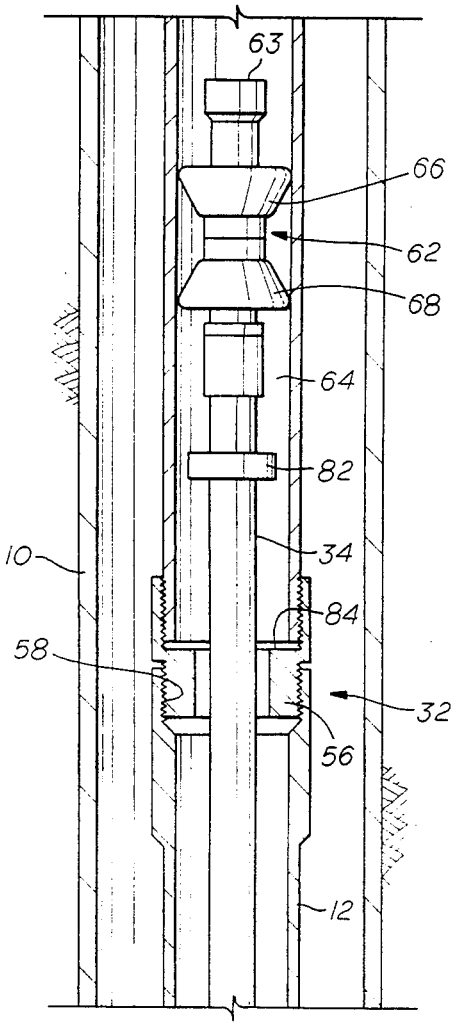
FIG. 4 is an enlarged sectional view of the intermediate portion of the gravel packing apparatus shown in FIGS. 1-3 and illustrating particularly the releasing tool for the liner.
Figure 6:
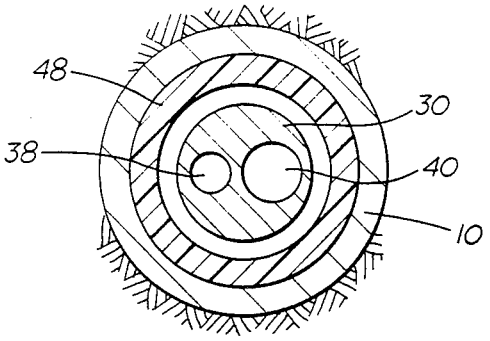
FIG. 6 is a section taken generally along the line 6—6 of FIG. 5.

Releasable connecting tool 32 as shown in FIG. 4 has an externally threaded lower end 56 which engages internally threaded upper end 58 of liner 12 for lowering liner 12 within casing 10 and then for release from liner 12 after liner 12 has been packed with gravel.

Figure 7:
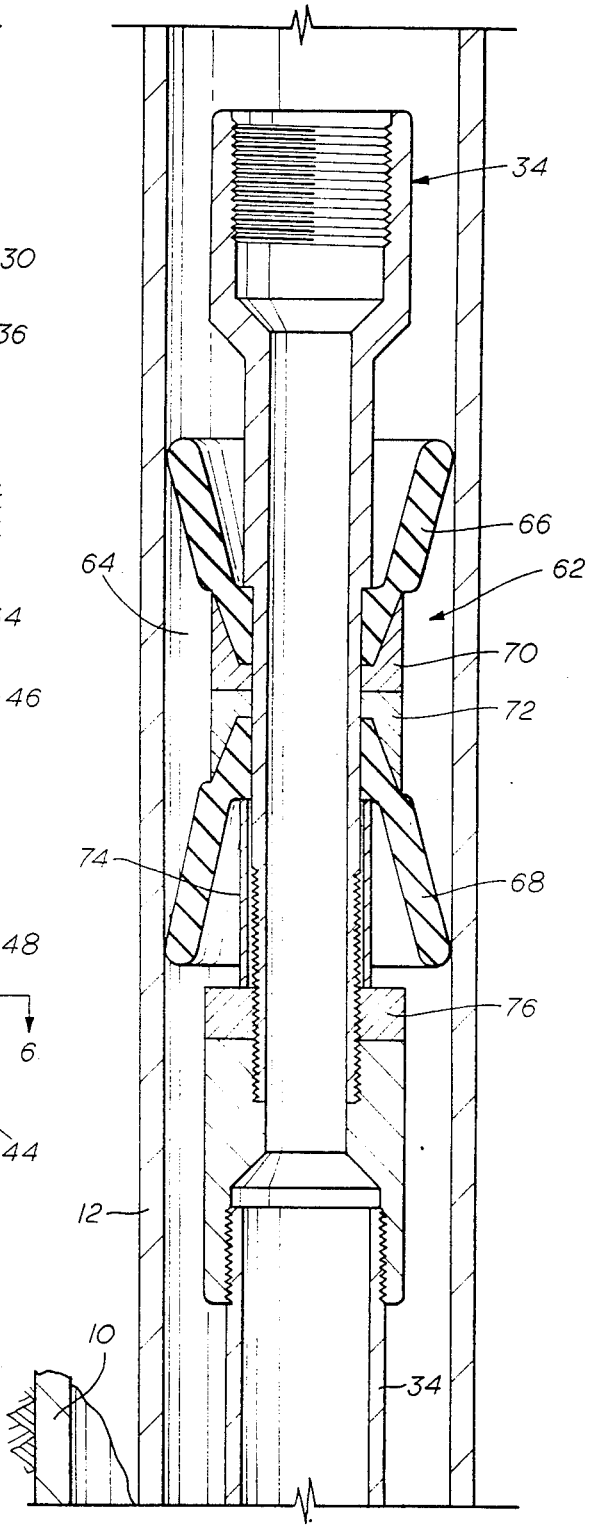
FIG. 7 is an enlarged longitudinal sectional view of the upper end portion of the wash pipe, showing the doubleacting piston fitting about the wash pipe and including a pair of opposed cup-shaped seal elements so that the wash pipe is responsive to fluid pressure from both directions.

Wash pipe 34 which forms an important part of this invention is mounted within an intermediate section between releasable connecting tool 32 and cross-over tool 30 and extends downwardly within liner 12 to a position adjacent the lower end of liner, 12. Wash pipe 34 is mounted for reciprocal movement within the intermediate section relative to liner 12 and cross-over tool 30. As shown in FIG. 7, a double acting piston shown generally at 62 is mounted in annulus 64 between wash pipe 34 and liner 12. Piston 62 includes oppositely-facing cup-shaped upper and lower resilient piston elements 66, 68 mounted forming elastomeric seals about the tubular body of wash pipe 34 by suitable mounting rings 70, 72 to effect a hydraulic actuation of wash pipe 34 between raised and lowered positions thereof. A retaining sleeve 74 fits between lower cup-shaped piston element 68 and lower mounting ring 72 to grip cup-shaped piston element 68 tightly. A lock nut 76 holds sleeve 74 in position.

The lower end of wash pipe 34 has a reduced diameter stringer 80 which fits within opening 22 and seats on seat 23 in metal-to-metal sealing relation in the wash-down position of wash pipe 34 as shown in FIG. 2 to provide a sealing connection between annulus 64 and the lower end of wash pipe 34. Such a sealing connection is necessary to provide sufficient fluid pressure from the end of wash pipe 34 in the wash down position to open check valve 25 and provide a jet action to stir up sand S and entrain such sand in the flowing fluid so that the sand is carried upwardly through annulus 20. So long as fluid flows down wash pipe 34, a metal-to-metal seal is provided at seat 23 as a result of fluid pressure acting against cup-shaped seal 66 to hold wash pipe 34 in a down position.

Upon reversal of fluid flow in wash pipe 34 to an up direction wash pipe 34 automatically moves as a result of fluid pressure acting on lower cup-shaped seal 68 to an up position for gravel packing without any other action required. Thus, stringer 80 is removed from the metal-to-metal seating relation on seat 23 and the sealing connection between the lower end of wash pipe 34 and annulus 64 is broken. A stop 82 is provided on wash pipe 34 adjacent its upper end portion below portion 62. Upon release of releasing tool 32 from liner 12 by rotation of tubing 29 in a counterclockwise direction and unthreading of tool 32, the raising of tubing 29 and releasing tool 32 causes shoulder 84 on tool 32 to engage stops 82 for withdrawal of wash pipe 34 with the cross-over structure 28 from the well.

In operation, releasable connecting tool 32 is threaded within the upper end of liner 12 and the entire cross-over structure 28 suspended from tubing 29 is lowered into the well by tubing 29. When the end of liner 12 bottoms on sand S in the production zone, then flushing or wash fluid is pumped from the surface down annulus 42, fluid passage 38, and down wash pipe 34 through stringer 80 where the flow of fluid opens check valve 25 to produce a jet action to stir up sand S and entrain such sand in the flowing fluid whereby the sand is carried upwardly in annulus 20 to passage 40 in cross-over tool 28, and then through tubing 29 to the ground level. By maintaining fluid flow, liner 12 is washed to the proper desired depth.

In the wash position as shown in FIG. 2, fluid pressure above piston element 66 acts against piston 66 to move and hold wash pipe 34 in the down position seated on seat 23 as shown in FIG. 2.

When liner 12 is positioned at the desired depth, the direction of fluid flow is reversed, as indicated in FIG. 3 and the change-over, if desired, to a different fluid for packing the gravel in the well is accomplished. Upon reversal of fluid flow as shown in FIG. 3 for gravel packing, fluid is directed from the surface down tubing 29, fluid passage 40 and annulus 20 about liner 12, then through production screen 16 into the lower end of wash pipe 34. Fluid flow is up wash pipe 34, fluid passage 38 in cross-over tool 30, and annulus 42 above cross-over tool 30 to the ground surface. Fluid pressure within liner 10 exerts fluid pressure against lower piston element 68 to move piston element 68 and wash pipe 34 to a raised position as shown in FIG. 2. In this position, wash pipe 34 is unseated from seat 23 and the sealing connection between wash pipe 34 and annulus 64 is broken. A pressure differential of around one hundred (100) PSI within liner 10 is sufficient to raise wash pipe 34, and may be as low as fifty (50) PSI under certain operating conditions and dimensioning. Wash pipe 34 and piston 62 are preferably raised around two (2) feet relative to the end of liner 12 with upper end 63 of wash pipe 34 engaging shoulder 65 on cross-over tool 30. Shoulder 65 acts as a stop to limit the upper movement of wash pipe 34. Production screens 16 may be from around ten (10) feet in length to around sixty (60) feet in length. The travel of wash pipe 32 would vary, dependent on the length of production screen 16 but would be from around a minimum of six (6) inches to a maximum of around five (5) feet under most operating conditions. A travel of around two (2) feet is preferred for raising the lower end of wash pipe 34 relative to liner 12.

After fluid changeover has been accomplished, gravel packing proceeds in the normal manner by pumping fluid with entrained gravel down through tubing 29, out into annulus 20 at liner 12 to fill the cavity about liner 12 with gravel in the production zone. When gravel G covers the tell tale screen 18, a rise in back pressure is noticed at ground level and this indicates the desired height of gravel packing has been reached.

When the gravel packing step has been completed, tubing 29 is rotated for release of connecting tool 32 from liner 12, and cross-over structure 26 including cross-over tool 30, connecting tool 32, and wash pipe 34 lifted by tubing 29 to the surface leaving liner 12 in gravel pack position within the production zone for well completion and production. After release of connecting tool 32, it is desirable to reverse the flow again so that any suspended solids in tubing 29 and liner 12 are removed with recirculation of fluid down wash pipe 34. When fluid return at surface is clean, the removal of cross-over structure 28 from the well is then completed.

The movement of wash pipe 34 is effected as a result of the reversal in fluid flow and thus does not require any external controls from ground surface or otherwise. The double acting piston 62 comprising a pair of opposed cup-shaped piston elements effects movement of wash pipe 34 in response to a pressure differential across opposed sides of piston 62. In the down wash position, a metal-to-metal seal is provided between wash pipe 34 and the interior of liner 12 to prevent direct fluid communication therebetween but in the gravel pack position with wash pipe 34 raised, the seal between wash pipe 34 and the interior of liner 12 is broken to provide direct fluid communication between the interior of liner 12 and the lower end of wash pipe 34.

Having fully described my invention, it is to be understood that such invention is not limited to the specific embodiments herein shown and described, but rather my invention is of the full scope of the appended claims.

I claim:

1. In a perforate liner wash-down and gravel packing apparatus for wells comprising, a perforated liner to be positioned within a well;

means connected to the upper end of the liner for lowering the liner into the well;

a wash pipe of smaller diameter than said liner connected to said lowering means and extending downwardly within said liner in generally concentric relation thereto;

means permitting fluid flow downwardly through the wash pipe into the well for washing the liner down prior to gravel packing and permitting a reverse flow upwardly through the wash pipe during gravel packing; and means mounting the wash pipe for vertical movement relative to the liner from a lower liner wash-down position to a raised upper gravel pack position, said mounting means being responsive to fluid pressure resulting from a reversal of fluid flow in the wash pipe upon the beginning of gravel packing to raise the wash pipe in the liner to said upper position, thereby to allow direct fluid communication between the lower end of the wash pipe and the inside of the liner during the raised gravel packing position.

2. In a perforate liner wash-down and gravel packing apparatus as set forth in claim 1 wherein said liner has a shoe at its lower end carrying a normally closed back pressure check valve, said check valve being opened in said wash-down position by the jet action of the downward flow of fluid from the lower end of the wash pipe.

3. In a perforate liner wash-down and gravel packing apparatus as set forth in claim 2 wherein the lower end of said wash pipe engages said shoe in a metal-to-metal sealing relation in said lower wash-down position.

4. In a perforate liner wash-down and gravel packing apparatus as set forth in claim 2 wherein said means mounting the wash pipe for vertical movement relative to the liner comprises oppositely facing cup-shaped seals mounted between the liner and the wash pipe and responsive to fluid pressure from the interior of the liner during the gravel packing position for moving the wash pipe to a raised position relative to the liner.

5. In a cross-over structure suspended from surface tubing for gravel packing a perforate liner in a well casing comprising:

a cross-over tool sealably mounted within the casing and having a pair of reversible fluid passages therein, one passage providing fluid communication between the tubing and the casing annulus below the cross-over tool, and the other passage providing fluid communication between the casing annulus above the cross-over tool and the inside of said liner below the cross-over tool;

a connecting tool below the cross-over tool releasably connected to the upper end of the liner for lowering the liner within the casing, and a tubular connecting barrel portion between the cross-over tool and the connecting tool;

a wash pipe of smaller diameter than said liner below the cross-over tool and extending downwardly within said liner in generally concentric relation thereto to form an annulus inside the liner, said wash pipe being in fluid communication with said other passage of said cross-over tool with a downward fluid flow from the casing annulus above the cross-over tool and down the wash pipe being provided for washing the liner down prior to gravel packing, and an upward reverse fluid flow up the wash pipe and up the casing annulus being provided during gravel packing; and means mounting the wash pipe for vertical movement relative to the liner from a lower liner wash-down position to a raised upper gravel packing position, said mounting means being responsive to fluid pressure resulting from a reversal of fluid flow through the wash pipe upon the beginning of gravel packing to raise the wash pipe in the liner to said upper position, thereby to allow direct fluid communication between the lower end of the wash pipe and the inside of the liner during the raised gravel packing position.

6. In a cross-over structure as set forth in claim 5 wherein said cross-over tool has a double-acting seal in sealing contact with the inner surface of the casing to seal the annulus from both directions.

7. In a cross-over structure as set forth in claim 5 wherein said means mounting the wash pipe for vertical movement relative to the liner comprises a piston mounted in the tubular connecting barrel portion between the cross-over tool and the connecting tool, and responsive to fluid pressure from the interior of the liner during the gravel packing position for moving the wash pipe to a raised position relative to the liner.

8. In a cross-over structure as set forth in claim 7 wherein said piston is double-acting and has a pair of cup-shaped seals about the wash pipe facing in opposite directions.

9. In a cross-over structure as set forth in claim 7 wherein after the gravel packing of said liner, said releasable connecting tool is released from said liner and said cross-over structure is removed from the well casing leaving said liner in gravel packed position within the casing for production.

10. In a cross-over structure as set forth in claim 5 wherein said liner has a shoe at its lower end carrying a seat for the lower end of said wash pipe, said wash pipe in the lower wash-down position being seated on said seat in a substantially sealing relation, and in the upper gravel packing position being unseated to provide direct fluid communication between the lower end of the wash pipe and the interior of the liner in the gravel packing position.

11. In a perforated liner wash-down and gravel packing apparatus for wells comprising, a perforated liner to be positioned within a well;

means connected to the upper end of the liner for lowering the liner into the well;

a wash pipe of smaller diameter than said liner connected to said lowering means and extending downwardly within said liner in generally concentric relation thereto;

means permitting fluid flow downwardly through the wash pipe into the well for washing the liner down prior to gravel packing and permitting a reverse flow upwardly through the wash pipe during gravel packing; and hydraulically actuated means mounting the work pipe for vertical movement relative to the liner between a lowered liner wash-down position resulting from the downward flow of fluid within the wash pipe and a raised gravel pack position resulting from the upward flow of fluid in the wash pipe, said hydraulically actuated means comprising a pair of oppositely facing cup-shaped seals secured to said wash pipe and positioned in the annulus between the wash pipe and liner for effecting movement of said wash pipe between said lowered and raised positions.

12. A method for gravel packing a liner in a production zone of a well comprising the steps of:

mounting a tubular wash pipe within a cross-over structure carrying a concentric perforated tubular liner for movement of the wash pipe relative to the liner between a raised gravel packaging position and a lowered wash-down position;

running within the well the cross-over structure thus formed suspended from a tubing with the cross-over structure having a cross-over tool carrying the perforated tubular liner with the wash pipe therein;

setting said cross-over structure in the well above the production zone with said wash pipe being responsive to fluid pressure resulting from fluid flow down the wash pipe for movement to said lowered position, and responsive to fluid pressure resulting from fluid flow up the wash pipe for movement to said raised position;

providing first and second fluid passages within the cross-over tool with the first fluid passage being in fluid communication with the wash pipe and the second fluid passage being in fluid communication with an outer annulus around the outside of the liner;

providing a fluid flow downwardly through said first passage and said wash pipe with the fluid pressure resulting therefrom effective to move the wash pipe relative to the liner to said lowered wash-down position and to effect movement of the combined liner and wash pipe to a predetermined depth within the well, the fluid flow in said outer annulus and said second fluid passage being in an upward direction; and then reversing the fluid flow to provide fluid with entrained gravel downward through said second fluid passage and the annulus outside the liner to pack gravel in the annulus about the liner with fluid flow in said wash pipe and said first fluid passage being in an upward direction, the fluid pressure within said liner resulting in the upward movement of said wash pipe relative to said liner to said raised gravel packing position whereby the lower end of the wash pipe is in direct fluid communication with the inside of the liner.

13. A method for gravel packing a liner in a production zone of a well comprising the steps of:

mounting a tubular wash pipe within a cross-over structure carrying a concentric perforated tubular liner for movement of the wash pipe relative to the liner between a raised gravel packing position and a lowered wash-down position;

running within the well the cross-over structure thus formed suspended from a tubing with the cross-over structure having a cross-over tool carrying the perforated tubular liner with the wash pipe therein;

setting said cross-over structure in the well above the production zone with said wash pipe being responsive to fluid pressure resulting from fluid flow down the wash pipe in which fluid flow between the wash pipe and the annulus inside the liner is blocked for movement of the wash pipe to lowered position and responsive to fluid up the wash pipe in which fluid flow between the annulus inside the liner and the wash pipe is permitted for movement of the wash pipe to raised position; and, providing fluid pressure responsive means between the liner and the wash pipe responsive to fluid pressure in the liner to move and hold the wash pipe relative to the liner in said lowered wash-down position in response to a downward fluid flow in the wash pipe, and to move and hold the wash pipe relative to the lines in a raised gravel packing position in response to an upward fluid flow in the wash pipe.

* * * * *